US005404742A

United States Patent [19]

Wilson et al.

[11] Patent Number: 5,404,742

[45] Date of Patent: Apr. 11, 1995

[54] ROTARY HEMMING DEVICE

[75] Inventors: David M. Wilson, Huber Heights, Ohio; John L. Meadows, Rockfall, Conn.

[73] Assignee: Ready Tools Inc., Dayton, Ohio

[21] Appl. No.: 89,235

[22] Filed: Jul. 9, 1993

[51] Int. Cl.[6] ..... B21D 5/04

[52] U.S. Cl. ..... 72/387; 72/319

[58] Field of Search ..... 72/387, 319, 396, 397

[56] References Cited

U.S. PATENT DOCUMENTS

| | | | |
|---|---|---|---|
| 3,301,034 | 1/1967 | Boettcher | 72/319 |
| 3,400,568 | 9/1968 | Brandner | 72/387 |
| 4,002,049 | 1/1977 | Randolph, Sr. | 72/387 |
| 4,181,002 | 1/1980 | Eckhold et al. | 72/387 |
| 4,434,644 | 3/1984 | Gargrave et al. | 72/387 |

FOREIGN PATENT DOCUMENTS

| | | | |
|---|---|---|---|
| 0383176 | 8/1990 | European Pat. Off. | 72/319 |

*Primary Examiner*—David Jones

*Attorney, Agent, or Firm*—H. Stanley Muir, III

[57] ABSTRACT

A method and device for hemming metal sheet involving upsetting the sheet metal to form a skirt at an angle to the parent sheet and for hemming the skirt to the parent sheet or another sheet interposed therebetween. Both skirt forming and hemming utilize rotary bending tools to convert perpendicular motion into rotational bending force. The novel device of the present invention is a rotary hemming tool having a cylindrical rocker characterized by a flat extending along its length with two lobes defining the intersection between the flat and the cylindrical surface of the rocker. The flat and the lobes are the surfaces of the rocker which act against the upset metal skirt and against the anvil on which the metal sheet is placed. The rocker and saddle are configured to limit rocker rotation such that skirt bending commences simultaneously with rocker contact rather than interaction between the rocker and the anvil. Skirts are bent at an obtuse angle in the first station to facilitate top-down layering of additional sheets on the parent sheet. The hemming tool in the second station secures in a single bending and coining operation the skirt against the top sheet to hem all layers to one another.

22 Claims, 6 Drawing Sheets

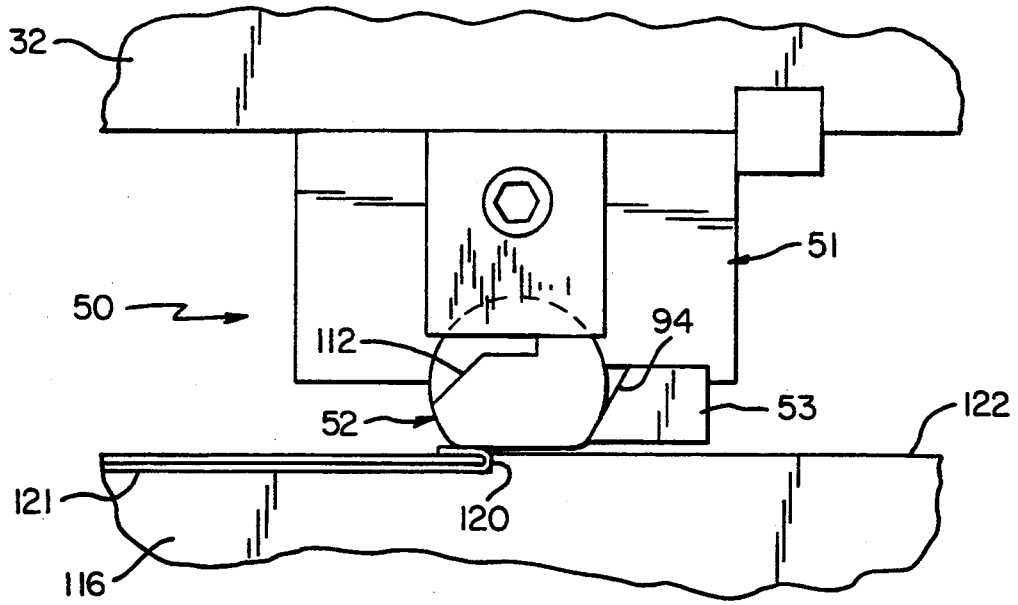
FIG-10
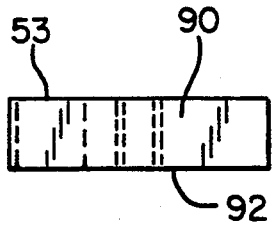
FIG-11A
FIG-11
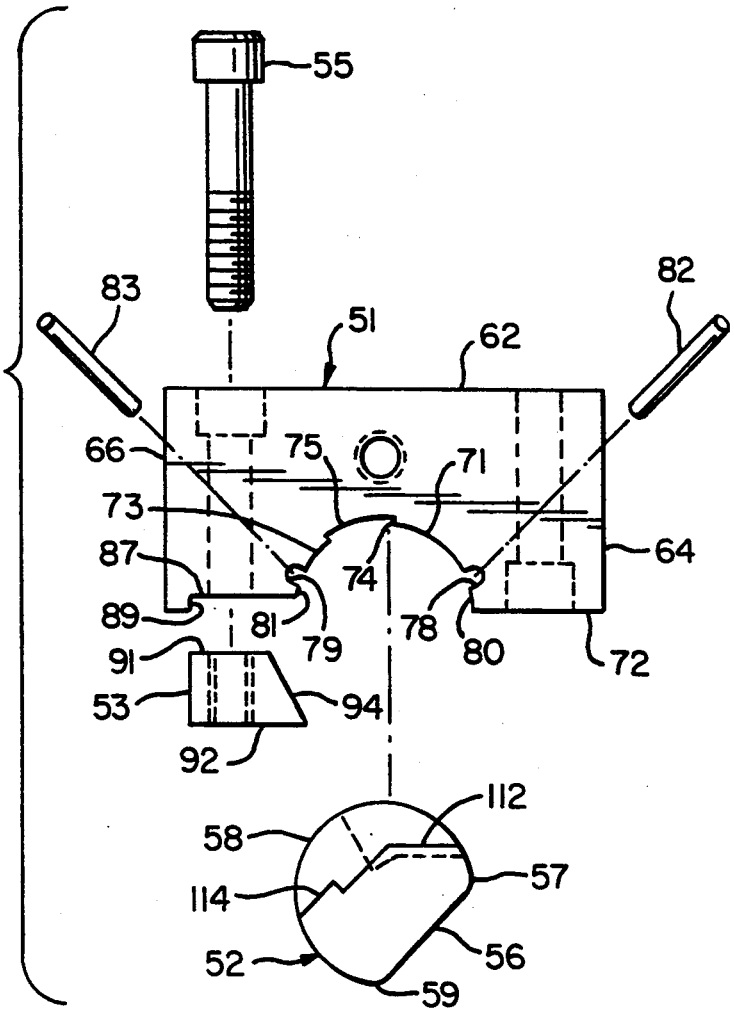

ROTARY HEMMING DEVICE

BACKGROUND OF THE INVENTION

FIELD OF THE INVENTION

The present invention relates to a means and method for hemming sheet metal or like material by converting perpendicular motion into horizontal bending forces and more particularly to rotary bending tools.

Manufacturers today form many parts by a stamping operation in a press brake, a punch press or by automation/special operation machine equipment. The term "press" is used in this specification to collectively refer to all such force engines. Conventionally, the press is provided with a set of dies appropriately mounted on the ram and bed of the press and the ram reciprocated with respect to the bed as sheet metal or similar material is fed into the press between the dies. Using the pressure provided by the press, the die faces act against the sheet forcing it to conform to the contours of the die faces.

Often, one or more portions of the sheet is to be bent back against itself or wrapped over another layer of sheet and bent to hold the two sheets fast to one another. Prior art accomplished hemming operations of this type through two methods.

I. Two Operations/Separate Die Sets. The first method involved sequential use of two die sets. The first operation on the sheet utilized a V-shaped die set, as shown in FIG. 1, which upset the sheet by the pressure of the press against the die set which in turn acted against the interposed sheet to bend the sheet to greater than ninety degrees. As shown in FIG. 2, in the second operation, a die set having flat contact faces forced the bent portion, or skirt, formed in the first operation, flat against the parent sheet. In the first operation, it was necessary to form the upset skirt at an acute angle relative to the parent sheet, and the smaller the angle the better, to assure that the flat-faced die used in the second operation continued to bend the skirt toward the parent sheet rather than away from it. If another sheet was to be hemmed between the parent sheet and its skirt, due to the acute angle of the bent skirt, the additional sheet had to be slid in from the side, rather than dropped from the top onto the parent sheet.

Using this method of hemming, the first die set presented the greatest obstacle to efficiency in press operation. By virtue of the way the die set acted against the interposed material the sheet could not be laid perpendicular to the direction of ram travel. Instead, the sheet had to be held parallel to one forming edge of the V-shaped die. Otherwise, as the die pair acted against the sheet, the sheet would bend at the edges of the die faces as well as at the desired location between the die faces. Consequently, to accommodate proper support of the sheet in the press, the press bed had to be positioned other than perpendicular to the direction of ram travel, or, alternatively, the operator had to position and hold the sheet by hand during press operation forming the skirt. This method of hemming made production set-up and operator control difficult, and made machine operation inefficient. If the operator was required to position the sheet by hand, this led to operator fatigue and improperly bent pieces. If hemming was to be accomplished with the minimum number of operations, the flat faces of the second die set required that the first die set produce a skirt bent at an acute angle with respect to the parent sheet to assure that the skirt would bend toward the parent material when acted on by the second die set.

Thus, the manufacturing operation faced a series of trade-offs involving the number of bending operations to complete a hem, the method of introducing additional sheets against skirted sheets, and positioning of sheets for initial skirt upset.

II. Single Station Operation/Combination Die Sets. The second method of prior art press bending combined the two die sets described above into a single combination die set commonly known as a "three-high" hemming die set. As shown in FIG. 3, in the three-high hemming die set an upper V-shaped die set upset the sheet material to form an acute angle between the skirt and the parent material while the lower flat-faced die set flattened the upset skirt against the parent sheet after initial overbending by the first die set. Sheet material is shown in both bending dies in FIG. 3 for illustration only, both dies not normally being used simultaneously.

The three high die set did not overcome the shortcomings of the sequential die operations described in the first method above. The sheet material still had to be positioned parallel to one working surface of the V-shaped die to avoid undesirable edge bends. For certain applications, the three high die demonstrated another shortcoming. Sheet insertion depth was limited by the central connection of the upper die to its companion lower die. Consequently, following working of the sheet, the sheet must be pulled backwards from the direction of insertion. This increased the difficulty of usage with a multi-station press since it blocked passage to insert the piece from one side and remove it from the other.

To increase productivity and efficiency, fabricators have recognized the value of reducing the number of hemming operations. Ideally, a hemming machine or operation should upset a skirt completely around the parent sheet in a single operation. Additional sheets would then be loaded directly against the parent sheet inside the upset skirt and the skirt hemmed against the sheets in a single bending operation. To facilitate insertion of additional sheets, the angle of the upset skirt with respect to the parent sheet would be obtuse to enable insertion of additional sheets from above.

Conventional hemming methods will not allow for this, requiring either that additional sheets be bowed for insertion from above the parent sheet, or that one end of the parent sheet not be upset so that additional sheets could slide in from the side, or that more than two bending operations be performed to gradually collapse the skirt about the additional sheets to hem them together. Clearly, there is need for a hemming tool which would minimize the number of operations needed to hem yet which permits easy introduction of sheets to be hemmed against one another.

An additional problem with hemming metal sheet is spring back, the tendency of the skirt to not remain flat against the parent sheet but to remain at some acute angle with respect to the parent sheet. To overcome spring back, the final operation on the skirt must "coin" the skirt, that is, press the skirt, notably at its bend, tightly against the parent sheet and work the metal sufficiently to remove spring back. Often, conventional hemming methods required an additional coining operation to produce a satisfactorily hemmed piece.

SUMMARY OF THE INVENTION

The present invention provides simple and effective means for avoiding the above noted problems attendant to press bending.

The present invention substantially precludes damage to the part being formed, uses forming equipment of lower tonnage, places the material to be worked on the forming equipment bed perpendicular to the direction of ram travel, and permits additional sheets to be loaded for hemming directly down on the sheet already having an upset skirt on all sides. Further, the present invention permits the sheets to be loaded in the press from the front, back, or sides.

The method and apparatus of the invention, moreover, provides means and method for effecting a hemming operation which are economical to employ, more efficient and satisfactory in use and adaptable to a wide variety of hemming applications.

In the preferred embodiment of the method of the present invention, the sheet material is first presented to a rotary bender somewhat like that disclosed in U.S. Pat. No. 4,434,644 which upsets the sheet material to form a skirt at an obtuse angle to the parent sheet. This is accomplished with the parent sheet placed on the press bed perpendicular to the direction of ram travel. This avoids the need for constructing special fixtures to hold the material to be worked and the efficient conversion of the linear vertical motion and forces of the ram into rotational motion with forces normal to the surface of the sheet portion being worked. Other attributes and an explanation of the operation of this type of rotary bending tool appear in U.S. Pat. No. 4,434,644.

The second operation in the method of the present invention requires the apparatus of the present invention. The hemming tool of the present invention is a new and novel rotary type bending tool which hems a skirt in a single operation and is able to do so even for skirts upset at an obtuse angle with respect to the parent sheet. Conventional flat-faced hemming die sets will not do so. The hemming tool of the present invention further maximizes the efficiency of the press by transforming the linear vertical force of the ram to rotational force applied normal to the surface of the skirt. This permits the use of presses of lesser tonnage than would be required by conventional bending dies. This in turn reduces capital investment and the likelihood of repair and maintenance. Moreover, the hemming tool eliminates the need for any subsequent coining operation by applying a flat die face to the skirt to provide uniform pressure across the surface of the skirt and at its bend when the skirt is against the adjacent sheet material. Additionally, the hemming tool is designed to permit operation of the press without regard to whether the bender first contacts the skirt or the bed. The bender immediately commences bending the skirt at the time of initial contact between the bender and surface of the skirt. Equally important, the bender will automatically return to a predetermined initial position so that repetitive bends can be made without an operator manually resetting the bender.

Placing the parent sheet on the bed of the press normal to ram travel, in a closing action of a press, the rocker—the bending element of the hemming tool of the present invention—contacts both the upset skirt and the bed of the press and rotates to effect a smooth bending of the skirt to form a hem against the parent sheet or additional sheets placed atop the parent sheet to secure each to the other.

The hemming tool of the present invention comprises a generally cylindrical rocker element having a longitudinally directed flat. At each end, generally opposed to the flat, are two ledge sets, a pair of position ledges and a pair of overbend ledges. As a press in which the device is embodied closes, a lobe at the edge of the flat or the flat itself contacts the outside of the upset skirt. A second lobe at the other edge of the flat contacts the anvil of the hemming tool positioned on the bed of the press. Bending of the upset skirt is not dependent upon contact of the second lobe against the anvil.

The position ledges control rotational positioning of the rocker so that the flat is at a predetermined angle with respect to ram travel on down-stroke. The position ledges prevent rotation of the rocker counter to the direction of desired rotation and cause the first lobe or the flat itself to act against the skirt immediately upon contact with the skirt rather that delaying until the second lobe contacts and is acted upon by the anvil. The overbend ledges control the degrees of rotation of the rocker in the direction of desired rotation. The position ledges, second lobe and overbend ledges permit the action of the rocker, first, to translate back and forth between the first lobe and the flat contacting and acting against the skirt surface and, second, to hold the flat in a desired position to eliminate over bending. The overbend ledges contribute to the ability of the invention to consistently provide a flat die face—the flat—to apply uniform pressure against the skirt surface back toward the area of bend, to coin the surface and force a set preventing undesirable spring back and consequent separation of the skirt from the adjacent sheet. The rotary action of the rocker translates the vertical motion of the ram, and hence direction of applied force, to motion and pressure normal to the surface of the upset skirt. This maximizes the efficiency of the press and does so without imparting undesirable shear stresses to the sheet material as it is being bent.

In the apparatus of the present invention, means are included to hold the rocker in place, to return the rocker to its original radial position with respect to the direction of ram travel, to permit repeated rotation of the rocker without wear to the rocker or its housing, to lubricate the rocker and to inhibit migration of undesired dirt and debris into the device.

An object of the invention is to provide a new and improved method for hemming sheet material.

Another object of the present invention is to provide a rotary bending tool particularly useful in a hemming operation.

A further object of the invention is to provide a tool for hemming sheet material which rotates in the functioning thereof.

An additional object of the invention is to provide a hemming tool which maintains the application of force against and normal to the surface of the upset skirt to be hemmed.

Yet another object of the invention is to provide a hemming tool which immediately begins bending an upset skirt upon contact, the operation of which is unaffected by the sequence in which it contacts the sheet material to be bent or the bed of the press.

A further additional object of the invention is to provide a tool for hemming two or more sheets of material one to the other.

A still further object of the invention is to provide a tool for hemming layers of dissimilar sheets of material to one another by controlled bending of the upset skirt of the outer sheet by limiting the rotation of the tool and the portion of the skirt contacted by the tool.

With the above and other incidental objects in view as will more fully appear in the specification, the invention intended to be protected by Letters Patent consists of the steps of operation and features of construction, the parts and combinations thereof, and the mode of operation as hereinafter described or illustrated in the accompanying drawings, or their equivalents.

Referring to the accompanying drawings wherein are shown some but not necessarily the only forms of application of the present invention:

FIGS. 9 and 10 are schematic views of the hemming machine of the present invention showing the progressive movement of the hemming tool of the present invention to hem the skirt against a secondary sheet laid over the parent sheet.

FIGS. 11, 12 and 13 are, respectively, exploded side, back and bottom views of the hemming machine of the present invention.

Like parts are indicated by similar characters of reference throughout the several views.

DESCRIPTION OF A PREFERRED EMBODIMENT AND APPLICATION OF THE PRESENT INVENTION

The present invention was conceived to maximize the efficiency of vertical presses for hemming of sheet materials by converting vertical movement to rotational movement to constantly apply force in the desired direction of bending in both the upsetting and hemming operations.

The method of the present invention involves the use of two rotary benders, one for upsetting a skirt on the sheet material and one for hemming the upset skirt to the parent sheet material or against another interposed sheet. The new and novel bender of the present invention accomplishes the latter operation.

Figure 4:
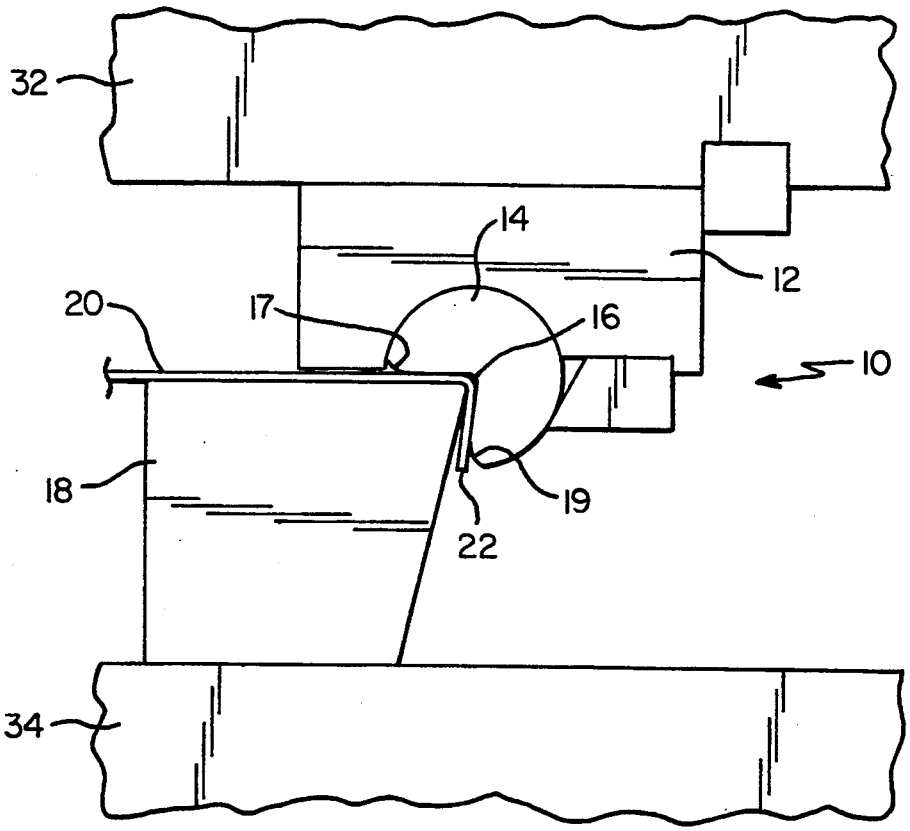
FIG. 4 is a fragmentary side view of a rotary bender having an anvil and operating head configured to produce upset skirts having an acute angle with respect to the parent sheet material.

The rotary bender 10, shown in FIG. 4, used for initial upsetting of the sheet material to form the skirt is a variation of rotary benders of a design akin to that described in U.S. Pat. No. 4,434,644 which discloses a rotary bending tool comprising a holder 12 and an operating head 14 in the nature of a generally cylindrical body having a V-shaped notch 16 defined by lobes 17 and 19.

As shown in FIG. 4, in the present invention if only a single sheet is to be hemmed, the V-shaped notch 16 and its mating anvil 18 are cut to an acute angle of less than 90 degrees. The notch 16 in operating head 14 presents lobes 17 & 19 as a pair of laterally spaced bearing surfaces for application to the sheet material 20 to be worked. Operating in a press with the holder 12 containing the operating head 14 attached to the reciprocating press ram 32 and anvil 18 attached to press bed 34, on the downward stroke of the ram 32 toward the anvil having sheet 20 positioned therebetween, lobe 17 holds sheet 20 against the upper surface of anvil 18 while lobe 19 bends sheet 20 about the face of anvil 18 to produce a skirt 22 at its edge. The unique capability of the rotary bender which lends the bender to initial upsetting of skirts is, while the sheet material remains perpendicular to the direction of travel of press ram 32, the operating head 14 in combination with the anvil 18 can upset a skirt 22 having an acute angle of as little as 60 degrees with respect to the parent sheet material 20, as illustrated in FIGS. 4. Further, the rotary bender is capable of producing the bend without adversely marring the surfaces of the sheet being bent and generally requires no additional hold down for the sheet since edge 17 acts as a clamping mechanism between the press and the sheet being worked.

Figure 5:
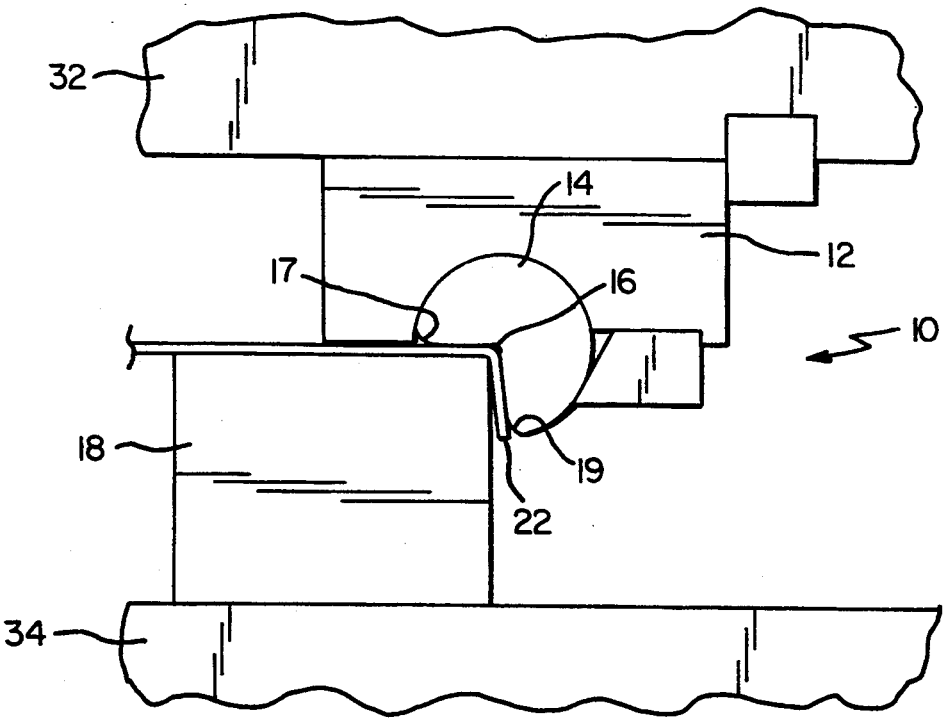
FIG. 5 is a fragmentary side view of a rotary bender having an anvil and operating head configured to produce upset skirts having an obtuse angle with respect to the parent sheet material.

If two sheets are to be hemmed together, in the preferred embodiment and as shown in FIG. 5, V-notch 16 and anvil 18 are formed to produce an obtuse bend, rather than an acute bend, in sheet 20. In the preferred embodiment, this obtuse angle is approximately 95 degrees with respect to the parent sheet for the skirt 22, although the bending operation, subsequently described, will produce satisfactory results even though the skirt is bent at other angles.

Once sheet material 20 has been worked by rotary bender 10 to produce skirt 22, sheet material 20 is transferred to a second press (or separate portion of the first press) and positioned to be acted on by the rotary hemming tool of the present invention.

With particular reference to FIGS. 6 through 13, the embodiment of the invention herein illustrated provides a rotary hemming tool 50 comprising a rocker 52 and its holder 54.

Figure 9:
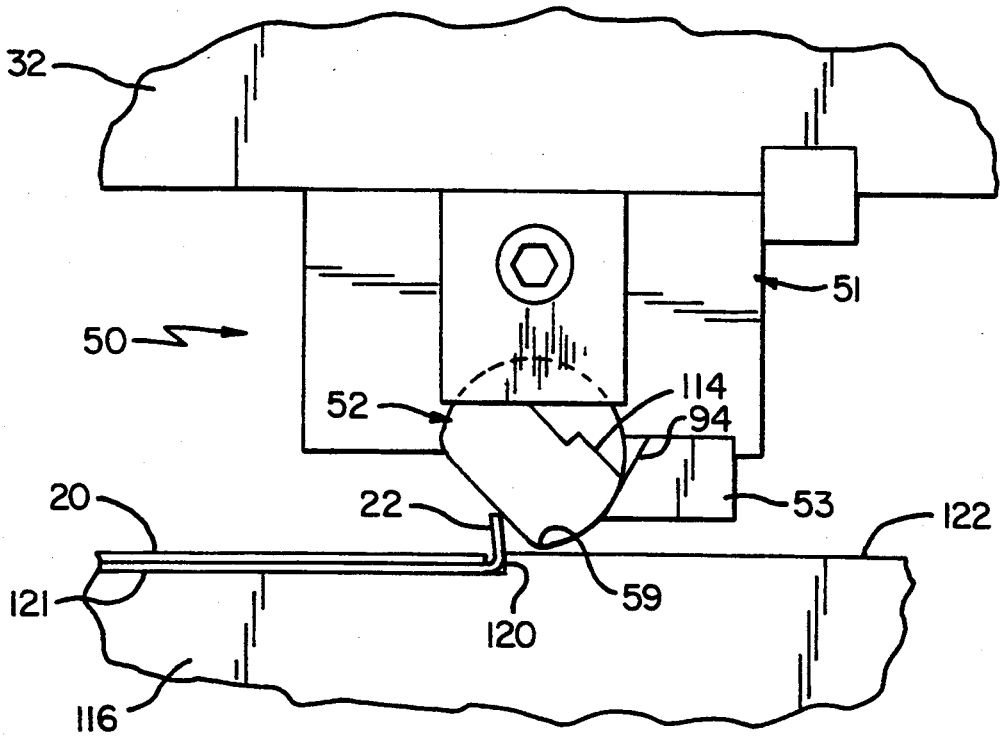

As shown in FIG. 9, the holder for the rocker 52 comprises a saddle 51 which seats the rocker 52 and a gib 53 which holds the rocker 52 in a stable, balanced relation to the saddle 51.

As is shown in FIG. 11, the rocker 52 is a generally cylindrical body modified by a flat 56 on and coextensive with its outer peripheral surface 58. The junctions between each of the outermost edges of flat 56 and the respectively adjacent portions of the outer peripheral surface 58 of the rocker have a smaller radius than the radius of the cylindrical portion of the rocker 52 to form lobes 57 and 59.

Figure 12:
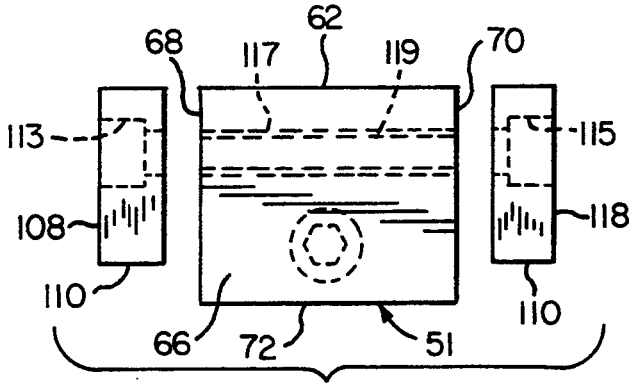
Figure 12A:
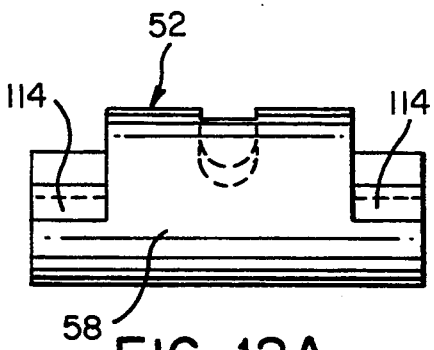
Figure 13:
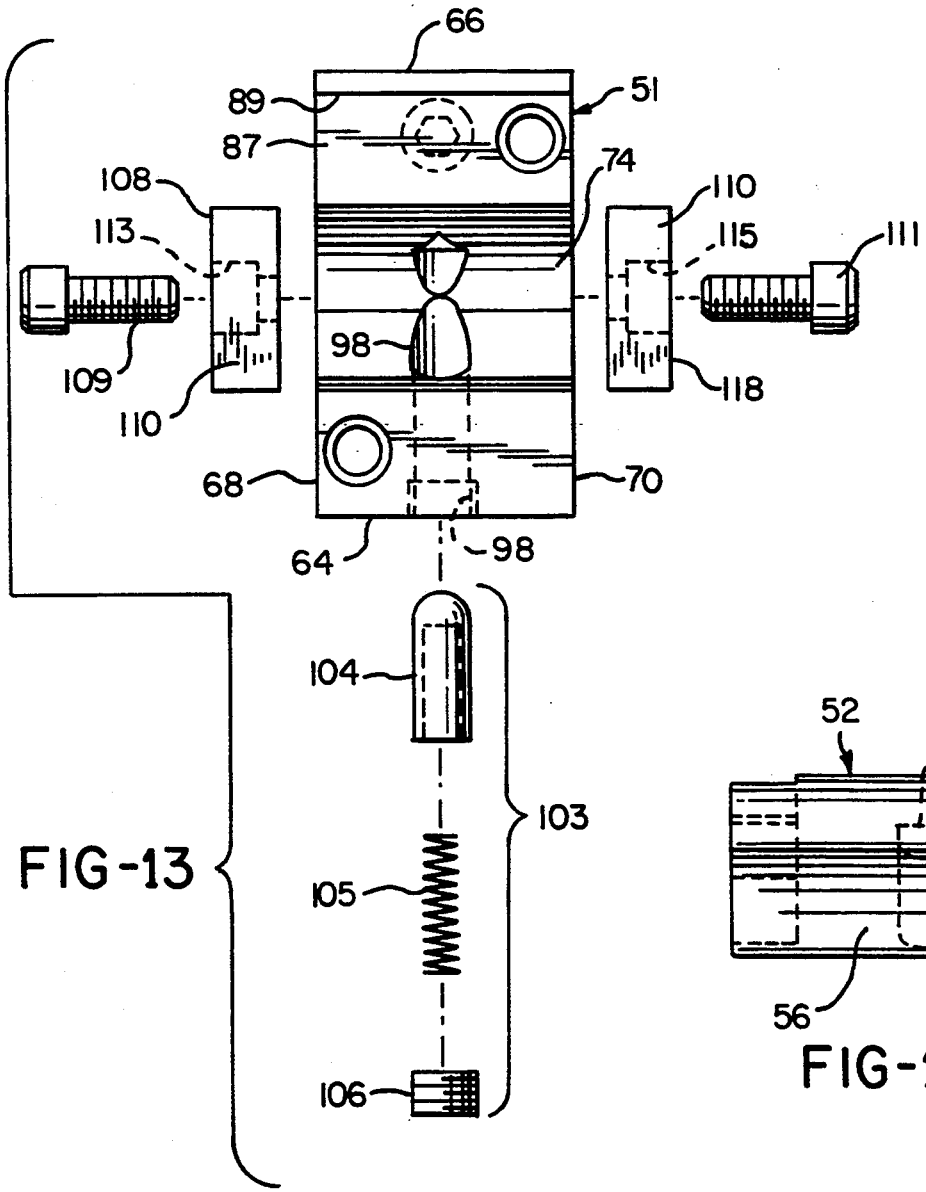
Figure 13A:
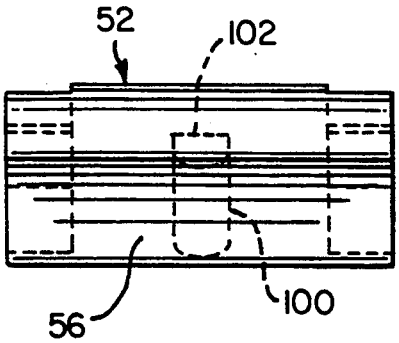

As can be seen from FIGS. 11–13, the saddle 51, basically formed of a rectangular block, has a rectangular planar surface 62 serving as its base; front and back surfaces 64 and 66, respectively, which are also planar and rectangular in configuration; and side surfaces 68 and 70 each of which is planar. The surfaces 64, 66, 68, and 70 are equal as to their height. The side, front and back surfaces are perpendicular to each other, to the base surface 62 and to the plane of the saddle's outermost surface portion 72, the latter of which laterally bounds a groove defined by sidewall 74, the seating portion of saddle 51.

As shown in FIG. 11, the groove 74 provides a generally hemi-cylindrical cavity which is directed inwardly of the outermost surface 72 at a location substantially centered between the front and back surfaces 64 and 66, respectively. The groove 74 extends between and has its ends at and opening from the side surfaces 68 and 70.

Three recesses are additionally cut in groove sidewall 74, each likewise extending between and having their ends at and opening from the side surfaces 68 and 70. In viewing the saddle 51 from the one side, with the upper center of the saddle considered to be the 12 o'clock position, the first recess is a relief 75 extending circumferentially from about 10:45 to about 12:05. At locations immediately of 9:30 and 2:30 along the groove side wall 74 are, respectively, recesses 78 and 79. In the preferred embodiment, recesses 78 and 79 are formed on groove sidewall 74 at the intersection therewith of 15 degree angles extending from the center of the groove at the plane of outer surface portion 72. Each recess 78 and 79 may be either rectangular or U-shaped in cross-section with a depth and width sufficient to nest approximately three-fourths of the circumference of a lubricant impregnated cord 82 and 83, respectively, shown in FIG. 10. The remainder of each cord 82 and 83 projects outwardly of the wall surface bounding the groove 74 to bear in wiping engagement with the outer peripheral surface 58 of the rocker 52.

Relief 75 and recesses 78 and 79 divide the outer surface 74 of the groove into four regions. Outer surface portion 72 and recesses 78 and 79 define between them, respectively, strip-like bearing portions 80 and 81. Relief 76 and recesses 78 and 79 define between them, respectively, lands 71 and 73. The radial surfaces of lands 71 and 73 and strips 80 and 81 are formed, in transverse section, on the same radius and, in effect are designed to resemble parallel circumferencially spaced segments of a cylinder having such a radius. The radius on which the outer surfaces of lands 71 and 73 and strips 80 and 81 are formed compliment and nest the cylindrical surface of the rocker 52.

The lands 71 and 73 and the strips 80 and 81 are the load accommodating portions of the saddle 51 and serve to seat the rocker 52 as it is nested in the groove 74. In the case illustrated, the nesting of the rocker 52 is to the extent of approximately 180 degrees of its circumference.

The outermost surface portion 72 of saddle 51, where it is intersected by groove 74 to form edge 86, is further intersected by a gib seat notch delineated by notch base 87 and notch wall 89.

Viewed from either end thereof, in cross section, notch base 87 is parallel to opposing rectangular planar surface 62 and notch wall 89 is perpendicular to notch base 87 and parallel to edge 86.

The gib 53 has a base portion 90 and a planar outer surface 92 parallel to one another and perpendicular side wall 91 therebetween. Base 90 and side wall 91 are designed to provide for the complementary interfit of gib 53 with and to notch base 87 and notch wall 89 when fully seated to the saddle 51. Gib 53 is configured so that in the full seating thereof it presents planar surface 92 perpendicular to the direction of travel of the press with gib side 94 being at an obtuse angle with base 90. Gib 53 is of such a thickness and gib side 94 is at such an angle that gib side 94 tangentially contacts rocker 52 beyond the outermost surface portion 72 of saddle 51. As shown in FIGS. 6–10, gib side 94 engages along its surface in a tangent, bearing, overlapping relation to a side portion of the rocker 52 in the saddle 51 which extends in a direction lenghtwise of its surface. This bearing engagement of the gib 53 holds the rocker 52 against its load accommodating seat in the saddle 51. Gib 53 is releasably anchored to the saddle 51 by a bolt 55.

A bore 98 is directed inwardly of the saddle front surface 64, substantially perpendicular thereto, to have one end open outwardly from the front surface 64 and the other end open through the groove side wall 74. A portion of bore 98 nearest to surface 64 is threaded. On the rocker 52, in a position to oppose bore 98 is an L-shaped channel 100 having an end wall 102. A return mechanism 103 comprised of a bullet tip 104 backed by a spring 105 resides in bore 98 and is secured in place and preloaded by a threaded locking plug 106. By preloading the return mechanism 103 and properly placing channel 100 with respect to flat 56, the rocker 52 residing in saddle 54 is predisposed to a spatial orientation presenting flat 56 at an angle to saddle outermost surface 72, which in the preferred embodiment is 45 degrees.

Kicker blocks 108 and 118 each have a stop surface 110 and are attached and positioned by locking screws 109 and 111, respectively, passing through bores 113 and 115, respectively, to engage with threaded bores 117 and 119 respecitvely in saddle base sides 68 and 70.

Figure 6:
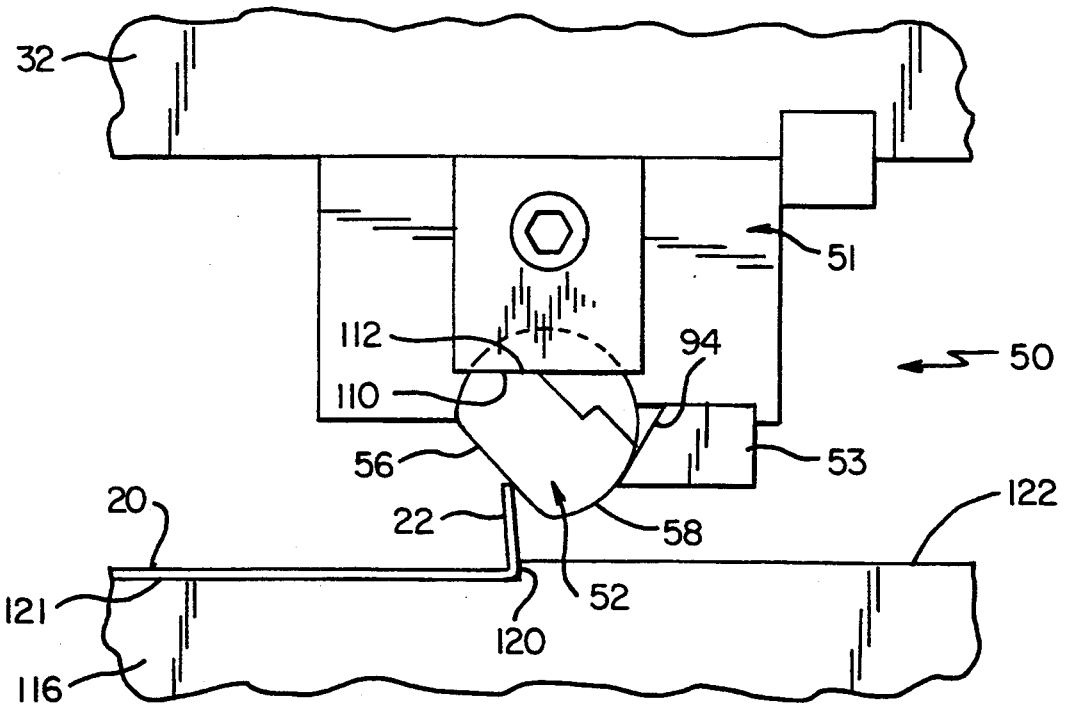
FIGS. 6, 7 and 8 are schematic views showing the progressive movement of the hemming tool of the present invention to hem the skirt against the parent sheet, coining it in place.

As shown in FIG. 11, both an initial positioning ledge 112 and a hemming lock ledge 114 are cut on each end of rocker 52. The ledges extend beyond saddle side surfaces 68 and 70 sufficiently for ledges 112 and 114 to interact with each stop surface 110 of the kicker blocks 108 and 118 as the rocker 52 rotates in saddle 51 during operation. While use of lock ledges 114 comprise part of the preferred embodiment, they are not essential to the practice of the invention. Initial positioning ledge 112 is cut in a predetermined angular relationship relative to the plane of flat 56, this being 45 degrees in the preferred embodiment. Thus, initial positioning ledge 112 seating against stop surface 110 impedes reverse rotation of rocker 52, which would otherwise be caused either by the preloaded return mechanism 103 and the interaction of its bullet tip 104 with land end wall 102 or, as shown in FIG. 6, by flat 56 being acted upon by contact with upset skirt 22 on the downward stroke of the press ram 32. By establishing the angular relationship between the initial positioning ledge 112 and flat 56, flat 56 is introduced to the upset skirt 22 of sheet material 20 at a predetermined angle of 45 degrees in the preferred embodiment.

Figure 8:
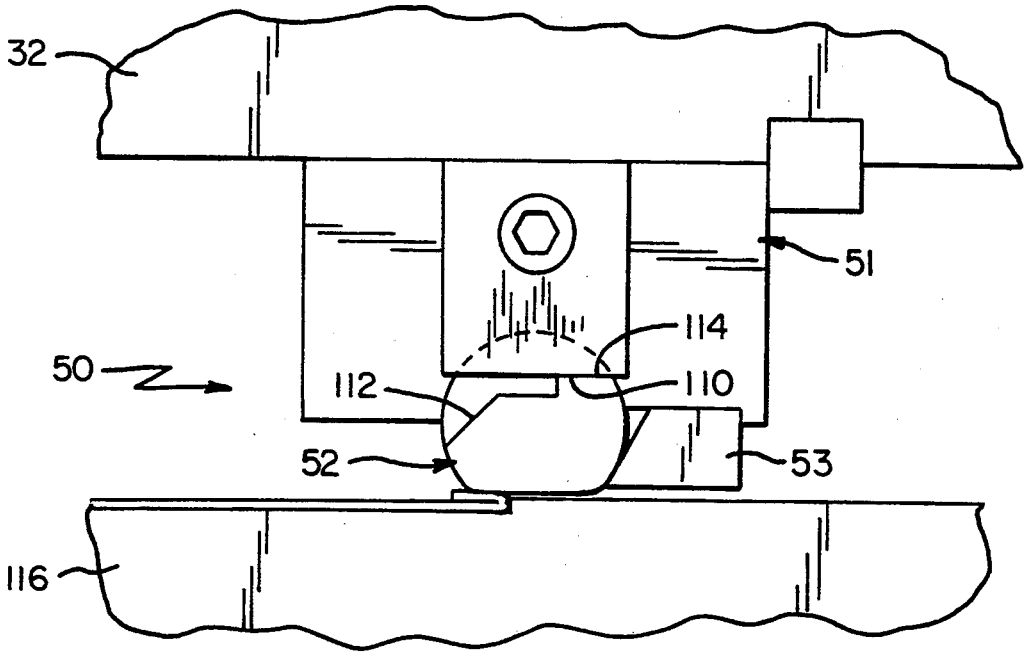

Likewise, by positioning hemming lock ledge 114 with respect to the plane of flat 56, forward rotation which would otherwise occur by the interaction between lobe 59 and any surface which it contacts is limited by stop surface 110 thus preventing overcoining of any sheet material being worked. In the preferred embodiment, as shown in FIG. 8, the hemming lock ledge 114 is cut on rocker 52 parallel to the plane of flat 56 causing flat 56 to be positioned perpendicular to the direction of ram travel when forward rotation of rocker 52 causes the hemming lock ledge 114 to contact stop surface 110.

Figure 7:
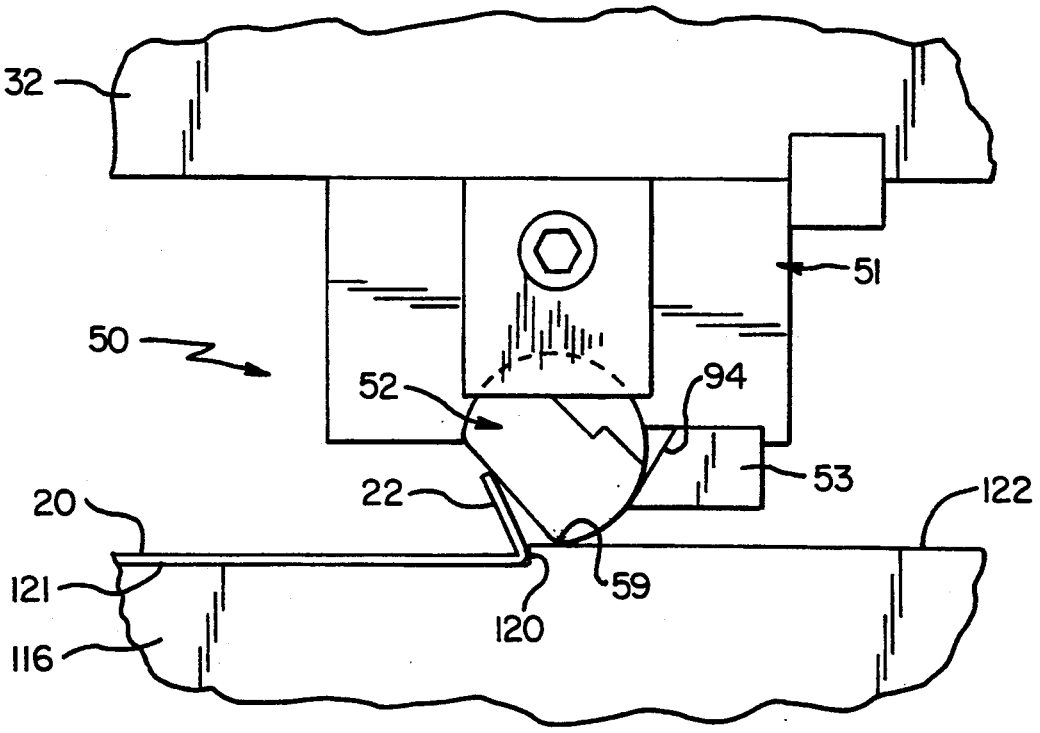

As shown in FIGS. 7 and 9, on the downward travel of the press ram 32, anvil 116 opposes rocker lobe 59.

The anvil 116 has an upper surface 122 which is positioned to interact with rocker lobe 59 on the downward stroke of the ram causing forward rotation of the rocker 52 and continuous change in the angle of the flat 56 until the contact area between the rocker 52 and the anvil 116 transitions from lobe 59 to flat 56 at which time the plane of the flat 56 parallels that of anvil upper surface 122. Anvil 116 is notched along upper surface 122, the notch defined by a base surface 121 parallel to anvil upper surface 122 and a side surface 120 perpendicular therebetween which acts as a butt plate to position sheet 20 and its upset skirt 22 at a predetermined position with respect to rocker 52.

This configuration presents several unique features in the functioning of the present invention over that of prior art benders. Because reverse rotation of the rocker 52 is prevented beyond that permitted by the interaction of the rocker initial positioning ledge 112 with the kicker block stop surface 110, as shown in FIG. 6, the rocker 52 commences bending immediately upon contact of either lobe 57 or flat 56 with skirt 22 regardless whether that contact first occurs between rocker 52 and skirt 22 or between rocker 52 and anvil 116.

This is a boon in setting up the bender because it reduces the need for closely tolerancing the rocker 52 and anvil 116 to one another. Furthermore, contact between the rocker 52 and the upset skirt 22 will not alter the position of the rocker 52 prior to its desired forward rotation upon contacting anvil 116.

This introduces the second unique advantage of the present invention. By altering the thickness of anvil 116 and positioning anvil 116 so that the line of contact of the rocker 52 with the anvil transitions from the lobe 59 to the flat 56, the radius of the bend induced in the sheet material at the intersection of skirt 22 and its parent sheet material 20 by the rocker 52 can be controlled and varied. As shown in FIGS. 9 and 10, where two pieces of sheet material 20 are to be hemmed to one another, a thicker anvil 116 will produce a larger radius at the intersection of the skirt 22 and its parent material 20. As illustrated in FIGS. 6–8, where a single sheet is to have its skirt hemmed against it, a thinner anvil 116 will produce a relatively tighter bend, one with a smaller bend radius, to assure a tight adjacency of the pieces without over-stressing the sheet material in the bend area. Varying the thickness of the anvil 116 also permits hemming tool 50 to accommodate materials of varying thicknesses and of varying compositions while achieving superior hemming results in each by controlling the bend radius consistent with the characteristics of each material.

While it is difficult to characterize a press operation as gentle, the method and apparatus of the instant invention will permit hemming of prepainted sheet materials without marring the painted surfaces which demonstrates the gentle functioning of the invention and shows its adaptability to operations for which conventional press dies do not produce comparable satisfactory results.

Figure 3:
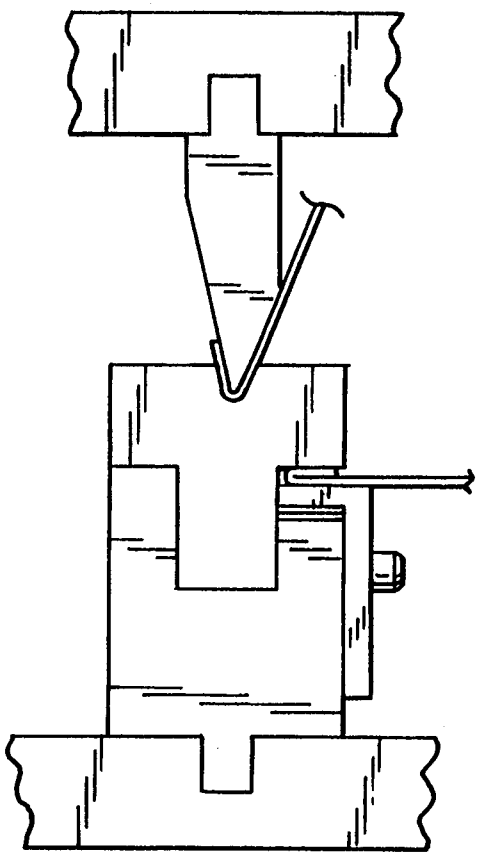
FIG-3 PRIOR ART
FIG. 3 shows a side view of a three high die set of the prior art illustrating upsetting of the skirt in the upper V-shaped die set and closing the upset skirt against the parent sheet after the upper V-shaped die set has upset the sheet material to form an acute angle between the skirt and the parent sheet. Sheets are shown in both die positions for illustration purposes only.
Figure 2:
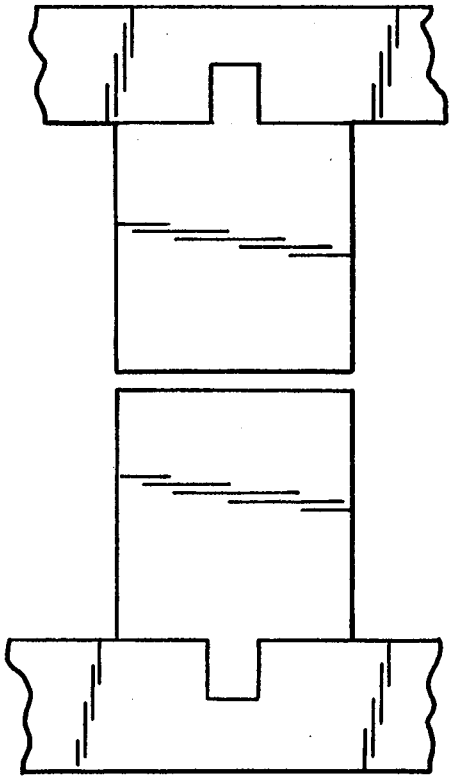
FIG-2 PRIOR ART
FIG. 2 shows a side view of a prior art flat-faced hemming die set in a press.
Figure 1:
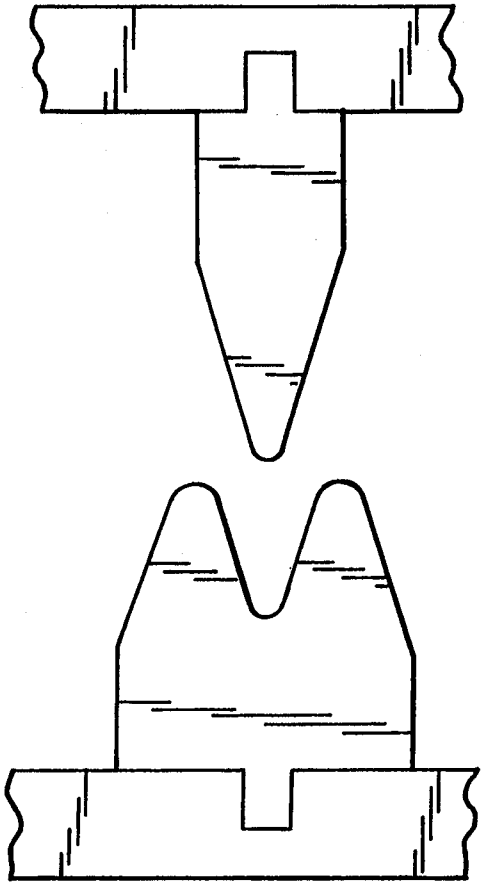
FIG-1 PRIOR ART
FIG. 1 shows a side view of a prior art V-shaped die set in a press.

A novel application of the instant invention is in the construction of door panels for automobiles. Often a polished metal trim strip is used to secure carpeting or vinyl to a hardboard backing. Darts from the trim strip penetrate the backing and are bent over to secure the trim strip to the backing board. The trim strip has a flat back and a skirt bent over its front which is typically polished since it is exposed to occupants of the vehicle. The purpose of the trim strip is two-fold: to provide accent to the door panel and to secure abutting materials, typically carpeting or cloth, to the backing. Consequently, the trim strip must hold the carpeting or cloth securely without cutting through the sheet and without marring the polished surface of the trim strip. Impact type hemming dies such as those illustrated in FIGS. 2 and 3 have proven unsatisfactory in meeting these requirements, either marring the surface of the trim strip, failing to anchor the material to the strip, or cutting through the material as it is hemmed between the trim strip back and skirt. Using the method and tool of the instant invention produces a controlled bend in the initial creation of the skirt without marring its polished outer surface through the use of a rotary bending tool and hems the material in the trim strip while controlling the radius of the bend between the skirt and the trim strip back and, finally, coins the outer skirt against the material without the skirt edges cutting through the material and, by the smooth movement of the flat against the surface of the skirt, creates no marring of the polished outer surface of the skirt.

A further advantage of the present invention is created by the transition from the lobe 59 to the flat 56 as the interactive surface between rocker 52 with the anvil 116. This change in surface profile produces a surface orientation and configuration for rocker 52 comparable to that of the conventional hemming die of FIG. 2. Flat 56 is oriented parallel to anvil upper surface 122 and perpendicular to the direction of ram travel by interaction of a portion of flat 56 with anvil upper surface 122 and by interaction of hemming lock ledge 114 and stop surface 110. In this configuration, flat 56 coins the skirt 22 causing it to remain tightly against the adjacent sheet material.

Of course, the invention has been described herein with particular reference to a preferred embodiment. It nevertheless remains that those versed in the art will be able to adapt various forms of holder devices and rocker units or elements to incorporate one or more of the features illustrated which lend significant benefits and advances in the art.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structual features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

What is claimed is:

1. In a press having a reciprocating ram opposing a bed on which a bendable sheet material having an upset skirt is placed, a rotary hemming tool comprising:

a saddle attached to the ram facing the bed, said saddle having a surface penetratingly extending between saddle longitudinal ends which defines a hemi-cylindrical groove cut along its length facing the bed;

rotatably disposed in said saddle groove, a generally cylindrical rocker having its cylindrical surface altered by a single flat surface portion extending its length and by lobes at the transition from said flat surface portion to said cylindrical surface, said rocker lobes of lesser radius than the circumference of said rocker;

an anvil having a flat outer surface, said anvil attached to the press bed in an opposing relationship to said rocker.

2. The hemming tool of claim 1 further comprising:

means for limiting the rotation of said rocker in said saddle between a predetermined initial position and a predetermined final position to thereby control the initial and final position of said flat and said lobes with respect to said anvil and with respect to the bendable sheet material.

3. The hemming tool of claim 2 in which said means for limiting the rotation of said rocker comprises:

a portion of said rocker extending beyond at least one said saddle longitudinal end, said rocker end portion having a surface which defines two generally flat ledges parallel to the axis of said rocker and set at a predetermined angle with respect to one another and with respect to said flat surface portion of said rocker;

a kicker block attached to said saddle end beyond which said rocker extends having a generally flat stop surface in interactive relationship with one said ledge at a predetermined forward rotation of said rocker in said saddle and with the other said ledge at a predetermined reverse rotation of said rocker in said saddle.

4. The hemming tool of claim 3 in which said anvil upper surface is relieved by a notch defined by a base surface parallel to said anvil upper surface and a side surface perpendicular there between.

5. The hemming tool of claim 4 further comprising means for preloading said rocker in said saddle so that said rocker rotates in a predetermined direction when said rocker is not interacting with other surfaces.

6. The hemming tool of claim 1 further comprising:

a gib attached to said saddle to hold said rocker in said groove.

7. The hemming tool of claim 6 further comprising:

at least one relief defined by two side walls extending inwardly from the wall of said groove and a base surface therebetween penetratingly extending between saddle longitudinal ends generally opposed to the opening of said groove on said saddle.

8. In a press having a reciprocating ram opposing a bed on which a bendable sheet material having an upset skirt is placed, a rotary hemming tool comprising:

a saddle attached to the ram facing the bed, said saddle having a surface penetratingly extending between saddle longitudinal ends which defines a hemi-cylindrical groove cut along its length;

rotatably disposed in said saddle groove, a generally cylindrical rocker having its cylindrical surface altered by a single flat surface portion extending its length and by lobes at the transition from said flat surface portion to said cylindrical surface, said rocker lobes of lesser radius than the circumference of said rocker;

means for radially positioning said rocker so that said flat surface portion is initially positioned at a predetermined angle with respect to the direction of ram travel;

means for preventing reverse rotation of said rocker beyond its initial radial position;

an anvil having a flat outer surface, said anvil positioned and attached to the press bed in an opposing relationship to said rocker, the interaction of said anvil and said rocker forming a line of contact between said anvil flat outer surface along the length of said rocker initially on one of said lobes and transitioning to a portion of said flat surface portion as the distance between said rocker and said anvil diminishes with the downstroke of the ram and the contact between said rocker and said anvil causes said rocker to rotate in said saddle;

means for limiting forward rotation of said rocker beyond a predetermined angle of radial rotation.

9. The hemming tool of claim 8, in which said anvil has a side extending above the surface of the press bed against which the sheet material is butted to properly position the upset skirt with respect to said rocker.

10. The hemming tool of claim 9, in which said means for radially positioning said rocker comprises:

a portion of said rocker extending beyond at least one said saddle longitudinal end, said rocker end portion having a surface which defines a generally flat first ledge parallel to the axis of said rocker and at a predetermined angle with respect to said flat surface portion of said rocker;

a kicker block attached to said saddle end adjacent said saddle groove having a generally flat stop surface in interactive relationship with said first ledge at a predetermined forward rotation of said rocker in said saddle.

11. The hemming tool of claim 10 in which said means for radially positioning said rocker is further comprised of:

a surface defining a bore extending from the side of said saddle toward which forward rotation of said rocker occurs and communicating with said groove, said bore being threaded a portion of its distance from said saddle side;

a land on the circumference of said rocker having an end wall;

a spring loaded bullet mechanism residing in said bore and contacting said land end wall; and a threaded plug threadedly inserted in said bore behind said spring loaded bullet mechanism which by the depth of its insertion imparts a preloading to said mechanism against said land end wall causing said rocker to rotate in the direction of reverse rotation under no load conditions until said first ledge contacts said stop surface.

12. The hemming tool of claim 11 in which the means for preventing forward rotation of said rocker beyond a predetermined angle of radial rotation comprises:

a portion of said rocker extending beyond at least one said saddle longitudinal end, said rocker end portion having a surface which defines a generally flat second ledge parallel to the axis of said rocker and set at a predetermined angle with respect to said flat surface portion of said rocker and with respect to said first ledge;

a kicker block attached to said saddle end beyond which said rocker extends and adjacent said saddle groove having a generally flat stop surface in interactive relationship with said second ledge at a predetermined forward rotation of said rocker in said saddle.

13. A rotary bender for a press having a reciprocating ram and a bed for hemming sheet material having a upset skirt, comprising:

a generally cylindrical rocker which transitions from a line of contact between said rocker and the upset skirt to a plane of contact between said rocker and the upset skirt, said rocker having a single flat surface portion extending longitudinally and a lobe at each transition between said flat surface portion and the circumference of said rocker, the two said lobes of lesser radius than the radius of said rocker; and one said lobe and a portion of said flat surface portion in transitional contact with an anvil having a flat contact surface approximately perpendicular to the direction of travel of the press ram, said lobe initially contacting said anvil on the downward stroke of the ram and said flat subsequently contacting said anvil as the ram continues its downward stroke.

14. A method for hemming flat sheet material comprising the steps of:

placing the sheet material in a press having a reciprocating ram and a bed and having attached to said press bed an anvil having a sidewall and having attached to said ram a rotary bender saddle having a surface defining a hemi-cylindrical groove along its length in which resides a generally cylindrical rocker, said rocker having a notch defined by two side walls with lobes of lesser radius than the circumference of said rocker at the transition between said side walls and said circumference of said rocker, said notch and said anvil having a complementary sidewall relief of less than ninety degrees;

causing said ram to stroke toward said bed;

contacting one said notch lobe against a portion of the sheet material supported by the bed to clamp the sheet material in place;

continuing the stroke of the ram to rotate said rocker to convert a portion of the linear movement of said ram to rotational movement of said rocker such that the other said notch lobe moves against the unsupported portion of the sheet material causing the sheet material to bend about said anvil and against said sidewall to form a skirt on the sheet material having an obtuse angle with respect to the sheet material;

transferring the sheet material with the upset skirt to a second press having a reciprocating ram and a bed and having attached to said ram a rotary bender saddle having a surface defining a hemicyclindrical groove along its length in which resides a generally cylindrical rocker, and attached to said press bed an anvil, said rocker having a flat along its length and further having a lobe at each transition between the circumference of the rocker and the flat, said two lobes having a radius less than the radius of said rocker, said anvil having a flat outer surface the plane of which is approximately perpendicular to the direction of ram stroke, said rocker and said anvil positioned for their line of interaction to initially occur at one said lobe and to transition to said flat as said rocker is rotated by the downward stroke of said ram;

causing said press ram at this said station to downstroke;

contacting the upset skirt with said rocker flat causing said flat to bend the skirt toward the sheet material;

contacting said anvil with said rocker on one said lobe causing said rocker to rotate and said line of interaction between said rocker and said anvil to transition to said flat, said flat thereby positioned substantially perpendicular to the direction of ram stroke and pressed against the skirt to coin the skirt against the sheet material to produce a controlled, gentle bend between the skirt and the parent material without spring back and without marring of the sheet material.

15. The method for hemming flat sheet material as in claim 14 comprising the additional step of:

during ram stroke converting a portion of the linear motion of the ram to rotational motion of the other said lobe against the skirt by the rotation of said rocker caused by the interaction of the one said lobe against said anvil.

16. The method for hemming flat sheet material as in claim 14, comprising the additional step of:

after forming the skirt, placing a second piece of sheet material on the skirted sheet material inside the skirt, the second piece of sheet material being of a predetermined size and configuration that a portion of its periphery is bounded by the skirt and placing both pieces of sheet material in the second press.

17. In a press having a reciprocating ram opposing a bed on which a bendable sheet material having an upset skirt is placed, a rotary hemming tool comprising:

a saddle attached to the ram facing the bed, said saddle having a surface penetratingly extending between saddle longitudinal ends which defines a hemi-cylindrical groove cut along its length facing the bed;

rotatably disposed in said saddle groove, a generally cylindrical rocker having its cylindrical surface altered by a flat extending its length and by lobes at the transition from said flat to said cylindrical surface, said rocker lobes of lesser radius than the circumference of said rocker;

an anvil having a flat outer surface, said anvil attached to the press bed in an opposing relationship to said rocker;

a portion of said rocker extending beyond at least one said saddle longitudinal end, said rocker end portion having a surface which defines two generally flat ledges parallel to the axis of said rocker and set at a predetermined angle with respect to one another and with respect to said rocker flat;

a kicker block attached to said saddle end beyond which said rocker extends having a generally flat stop surface in interactive relationship with one said ledge at a predetermined forward rotation of said rocker in said saddle and with the other said ledge at a predetermined reverse rotation of said rocker in said saddle to limit the rotation of said rocker in said saddle between a predetermined initial position and a predetermined final position to thereby control the initial and final position of said flat and said lobes with respect to said anvil and with respect to the bendable sheet material.

18. The hemming tool of claim 17 in which said anvil upper surface is relieved by a notch defined by a base surface parallel to said anvil upper surface and a side surface perpendicular there between.

19. The hemming tool of claim 18 further comprising means for preloading said rocker in said saddle so that said rocker rotates in a predetermined direction when said rocker is not interacting with other surfaces.

20. In a press having a reciprocating ram opposing a bed on which a bendable sheet material having an upset skirt is placed, a rotary hemming tool comprising:

a saddle attached to the ram facing the bed, said saddle having a surface penetrating extending between saddle longitudinal ends which defines a hemicylindrical groove cut along its length;

rotatably disposed in said saddle groove, a generally cylindrical rocker having its cylindrical surface altered by a flat extending its length and by lobes at the transition from said flat to said cylindrical surface, said rocker lobes of lesser radius than the circumference of said rocker;

a portion of said rocker extending beyond at least one said saddle longitudinal end, said rocker end portion having a surface which defines a generally flat first ledge parallel to the axis of said rocker and at a predetermined angle with respect to said flat portion of said rocker;

a kicker block attached to said saddle end adjacent said saddle groove having a generally flat stop surface in interactive relationship with said first ledge at a predetermined forward rotation of said rocker in said saddle;

means for preventing reverse rotation of said rocker beyond its initial radial position.

21. The hemming tool of claim 20 further comprised of:

a surface defining a bore extending from the side of said saddle toward which forward rotation of said rocker occurs and communicating with said groove, said bore being threaded a portion of its distance from said saddle side;

a land on the circumference of said rocker having an end wall;

a spring loaded bullet mechanism residing in said bore and contacting said land end wall; and a threaded plug threadedly inserted in said bore behind said spring loaded bullet mechanism which by the depth of its insertion imparts a preloading to said mechanism against said land end wall causing said rocker to rotate in the direction of reverse rotation under no load conditions until said first ledge contacts said stop surface.

22. The hemming tool of claim 21 further comprising:

a rocker portion extending beyond at least one said saddle longitudinal end, said rocker end portion having a surface which defines a generally flat second ledge parallel to the axis of said rocker and set at a predetermined angle with respect to said flat surface portion of said rocker and with respect to said first ledge; and a kicker block attached to said saddle end beyond which said rocker extends and adjacent said saddle groove having a generally flat stop surface in interactive relationship with said second ledge at a predetermined forward rotation of said rocker in said saddle.

* * * * *